US008733545B2

(12) United States Patent
Weiss et al.

(10) Patent No.: US 8,733,545 B2
(45) Date of Patent: May 27, 2014

(54) PACKAGING AND INSTALLATION SYSTEM FOR DOUBLE HUNG WINDOWS AND OTHER SLIDING CLOSURES

(75) Inventors: David Weiss, Stillwater, MN (US); Christopher Buege, Marine on St. Croix, MN (US)

(73) Assignee: Anderson Corporation, Bayport, MN (US)

( * ) Notice: Subject to any disclaimer, the term of this patent is extended or adjusted under 35 U.S.C. 154(b) by 0 days.

(21) Appl. No.: 13/368,949

(22) Filed: Feb. 8, 2012

(65) Prior Publication Data

US 2012/0198771 A1 Aug. 9, 2012

Related U.S. Application Data

(60) Provisional application No. 61/440,447, filed on Feb. 8, 2011.

(51) Int. Cl.
*E06B 7/00* (2006.01)
*E06B 3/44* (2006.01)

(52) U.S. Cl.
USPC ..... 206/325; 49/380

(58) Field of Classification Search
USPC ..... 49/380, 163, 183; 206/325; 29/525.01
See application file for complete search history.

(56) References Cited

U.S. PATENT DOCUMENTS

| | | | | | |
|---|---|---|---|---|---|
| 2,728,117 | A * | 12/1955 | Zappone et al. | 49/63 |
| 2,929,495 | A * | 3/1960 | Simonsen | 206/325 |
| 3,205,982 | A * | 9/1965 | Chimienti | 206/325 |
| 3,253,704 | A * | 5/1966 | Hillier | 206/321 |
| 3,584,416 | A * | 6/1971 | Baumgartel | 49/380 |
| 3,643,377 | A * | 2/1972 | Anderson | 49/181 |
| 4,691,477 | A * | 9/1987 | Governale | 49/380 |
| 4,920,713 | A * | 5/1990 | Borresen et al. | 52/200 |
| 5,209,017 | A * | 5/1993 | Ridge | 49/380 |
| 5,239,780 | A * | 8/1993 | Mott et al. | 49/380 |
| 5,365,697 | A * | 11/1994 | Vanderpan | 49/380 |
| 5,655,332 | A * | 8/1997 | Papadopoulos | 49/380 |
| 6,161,605 | A * | 12/2000 | Pena | 160/90 |
| 6,725,604 | B1 * | 4/2004 | Vanderpan | 49/380 |
| 7,100,329 | B2 * | 9/2006 | Pleasants | 49/465 |
| 7,581,352 | B2 * | 9/2009 | Klingbyle | 49/380 |
| 7,681,360 | B2 * | 3/2010 | Daniels et al. | 49/125 |
| 7,716,886 | B2 * | 5/2010 | Gordon | 52/213 |
| 7,757,365 | B2 * | 7/2010 | Ouellette | 29/410 |
| 7,856,760 | B2 * | 12/2010 | Klingbyle | 49/380 |
| 8,322,079 | B2 * | 12/2012 | Daniels et al. | 49/504 |
| 8,333,359 | B2 * | 12/2012 | Gordon | 248/547 |
| 2003/0005641 | A1 * | 1/2003 | Eakes et al. | 49/380 |
| 2004/0060241 | A1 * | 4/2004 | Staples et al. | 49/380 |

* cited by examiner

*Primary Examiner* — Katherine Mitchell
*Assistant Examiner* — Justin Rephann
(74) *Attorney, Agent, or Firm* — Womble Carlyle Sandridge & Rice LLP

(57) ABSTRACT

An improved packaging clip, packaging system, and method are disclosed for securing windows and doors and holding them square during shipment and installation. In one embodiment for a window unit, a packaging clip comprises a projection that fits into a jamb track channel in a window frame and a base that contacts and rests against the check rail of a window sash. The packaging clip may be fastened to each jamb of the window frame by a screw. A coupling member is pulled taught between the two packaging clips and fasteners are installed to attach the clips to the jambs and to secure the end portions of the coupling member to the clips. This holds the window frame intact and square during shipment and installation and, since the coupling member does not wrap around the outsides of the window frame, it does not interfere with installation of the unit.

27 Claims, 5 Drawing Sheets

PACKAGING AND INSTALLATION SYSTEM FOR DOUBLE HUNG WINDOWS AND OTHER SLIDING CLOSURES

REFERENCE TO RELATED APPLICATION

Priority is hereby claimed to the filing date of U.S. provisional patent application No. 61/440,447 filed on 8 Feb. 2011.

TECHNICAL FIELD

This disclosure relates generally to sliding closures such as windows and more specifically to the preparation and securing of sliding closures for shipment and installation.

BACKGROUND

Maintaining accurate alignment between the frame and sashes of a window is a major factor in providing a good seal against wind and water between the sashes and the frame, as well as ensuring smooth operation of slidable sashes. Alignment of the window unit sashes, frame, and other members relative to one another is best done during factory assembly of the window unit. However, it has proven difficult, and often economically unfeasible, to maintain proper alignment of the unit during transport and possibly warehousing and retail display of the window units, without taking special, possibly expensive and inconvenient measures. Similar considerations also apply to sliding doors and gliding windows.

Misalignment can take several forms. Jambs may become warped or bent outwards, due, for example, to the outward pressure of seals and weather stripping between the sashes and the jambs. Window units may be improperly stacked at some point in the transportation process, allowing the weight of the sashes to cause excessive compression of the seals or weather stripping, to the point of creep, thereby causing poor sealing when the sashes are returned to their proper position. Various bumping and dropping of the window units may cause the corner angles of frames to deviate significantly from their intended values, typically 90°, a phenomenon known as racking.

While robust packaging can improve the chances of window units arriving at the construction site in an aligned condition, such packaging can become expensive, and there is still the possibility that misalignment will occur after removal of the packaging, but prior to installation.

There is therefore a need to preserve the alignment of sliding closures such as windows provided at the factory throughout the transportation, sale, and installation, without adding excessive cost and without complicating the installation process.

SUMMARY

A shipping and installation fixture is provided that includes a pair of packaging clips located between the jambs and a sliding sash of a window unit, wherein the clips are attached to the jambs. During shipping and installation, the clips maintain a predetermined spacing between the sash and the jambs. The clips also include coupling brackets for connecting a tensioned coupling member such as a length of packaging strap between the clips. The tension of the coupling member urges the clips toward one another, thereby urging them into contact with the sides of the sash, thus reducing outward bowing of the jambs to which the clips are attached and frictionally coupling the sash to the jambs, thereby reducing the tendency of the frame to undergo racking. The clips also serve to reduce the risk of lock damage due to deformation of the window during shipping. Once installed at the factory, the fixture can remain on the window unit until installation in a rough opening of a building is complete; thereby further preserving the alignment provided at the factory. The fixture can be used with window units having either vertically sliding panels or horizontally sliding panels. The fixture can also be used with sliding doors.

BRIEF DESCRIPTION OF THE DRAWINGS

The components of the following figures are illustrated to emphasize the general principles of the present disclosure and are not necessarily drawn to scale. Reference characters designating corresponding components are repeated as necessary throughout the figures for the sake of consistency and clarity.

DETAILED DESCRIPTION

The present disclosure is directed to a packaging system for use in conjunction with sliding closures, such as triple hung windows, double hung windows 102 (FIG. 7), single hung windows, gliding windows with horizontally sliding sashes, patio doors with sliding door panels 202 (FIG. 8), or any other window or door unit that needs to be secured during shipment and held straight and square during installation. It will be understood that, although the system may be described below primarily in the context of a particular type of window such as a double hung or single hung window, such should not be construed to be limiting and the descriptions will be understood to apply to any type of window or door with sliding sashes or sliding panels mounted in frames.

An aspect of the disclosure is the use of a packaging system to improve the shipping and installation of windows. Another aspect of the disclosure is a method of applying a packaging system to a window. A further aspect of the disclosure is a system that holds a window or door square during installation but does not interfere with the installation process. These and other aspects will emerge through this detailed description.

Figure 1:
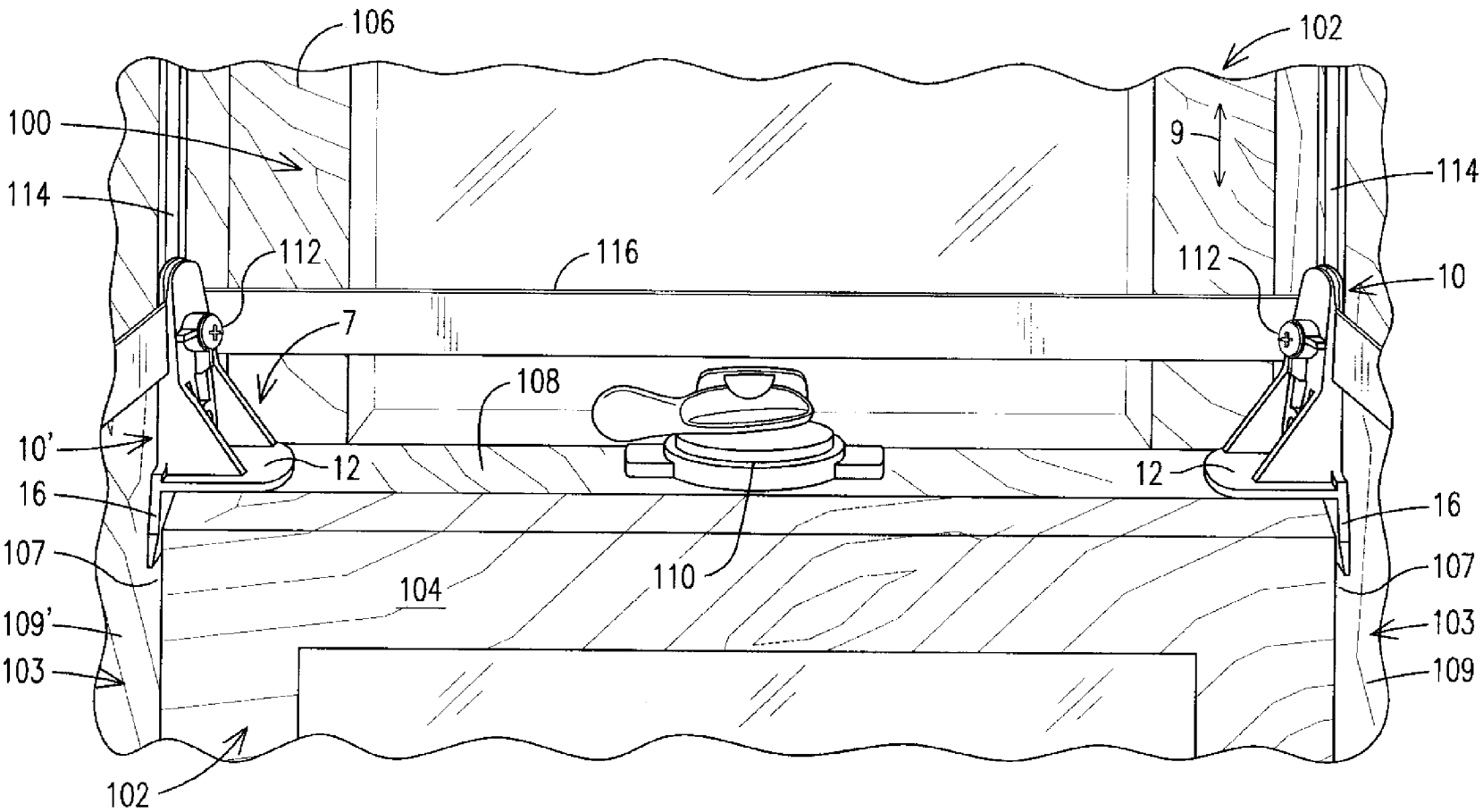
FIG. 1 is a perspective view of one embodiment of the packaging system of this invention shown installed to a double hung window unit.
Figure 2:
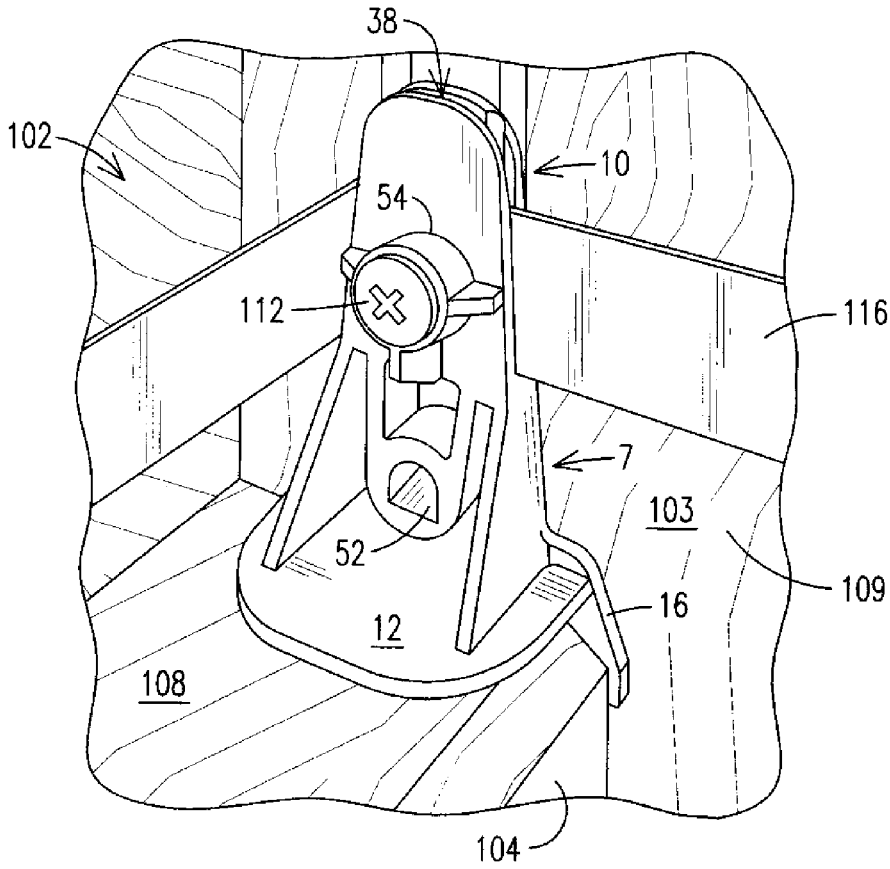
FIG. 2 is an enlarged perspective view of a portion of the packaging system of FIG. 1 shown installed to a double hung window unit.
Figure 7:
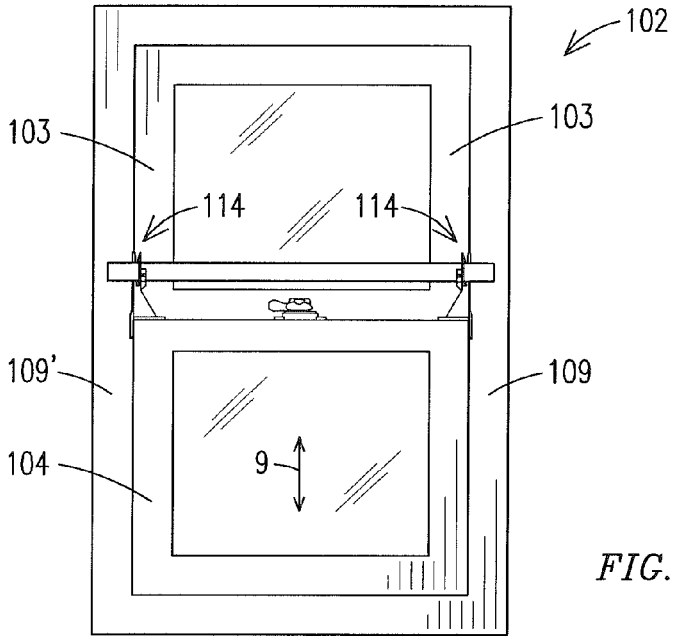
FIG. 7 is a front elevation view of the packing system and double hung window of FIG. 1.

FIGS. 1, 2 and 7 show a double hung window unit 102 that includes the system of the present invention for securing the window for shipping and holding it straight and square during installation. The window 102 is comprised of a window frame 103, which includes spaced vertical jambs 109 and 109', a lower window sash 104, and an upper window sash 106. The window frame 103 supports the lower and upper sash 104, 106 and the lower sash 104 is free to slide in the vertical direction 9 guided by jamb tracks or channels 114, in both jambs. The upper sash 106 also may be slidable up and down in the case of a double hung window, or it may be fixed in the case of a single hung window.

A desired clearance 107 exists between the jambs of the window frame 103 and the lower sash 104. The desired clearance is a spacing that ensures smooth sliding operation of the lower sash 104 while at the same time maintaining proper engagement with and compression of weather stripping between the sash and the jambs to inhibit drafts and leakage. Clips 10, 10' are disposed at the upper corners of the lower sash; i.e. at the ends of the check rail 108 of the sash, according to one embodiment of the invention. Each clip has a tab or tabs 16 that project downwardly between the sash and the adjacent jamb and the tabs have a thickness generally equal to the desired clearance 107. A base 12 of each clip rests atop the check rail 108 of the lower sash and a retainer 7 of the clip projects upwardly therefrom. A rear insert 26 of each clip (not visible in FIGS. 1 and 2) extends laterally into the jamb tracks 114 of the window frame jambs. Upper and lower openings 50 and 52 are formed in the retainer 7 for receiving screws 112 that are driven through the clips 10 and 10' and into the adjacent jamb to secure the clips in place. A fastener 112, a screw in this case, is arranged in the upper fastener passages 50 of each packaging clip 10, 10' and the screws are threaded into the adjacent jamb to secure the clips to the jambs. The basses 12 of the clips bear against the tops of the check rails and preferably are slightly convex in shape to minimize marring or scratching of the check rails. This locks the lower sash in place in its closed position and prevents it from sliding within the frame during shipment and also squares the frame and helps to prevent racking during shipment and installation. Although it is preferred to ship double hung windows unlocked to prevent damage, the upper sash may be secured against sliding by sash lock 110 or other device.

A coupling member 116 in the form of a strap or band in the illustrated embodiment has end portions disposed within slots 38 in the clips 10, 10' and the coupling member 116 extends between the two clips. The coupling member 116 is secured to the clips and thereby to the jambs by the screws 112. More specifically, the screws 112 extend through the upper openings 50, through the ends of the coupling member 116 disposed therein, and are threaded into the adjacent jamb of the frame. This closes the slots 38 through which the ends of the coupling member 116 extends to clamp the ends of the coupling member 116 within the clips. The coupling member 116 is sufficiently taught to hold the jambs of the window frame against the tabs 16 of the clips 10, 10', which keeps the jambs straight, prevents them from bowing outward, maintains the preferred clearance gap between the sash and the jambs, and holds the frame in this configuration during shipment and during installation.

At the manufacturing facility, a window or door unit is prepared for the packaging and installation system of this invention. The sliding sash is shut and the clips may be inserted at the ends of the check rail of the sliding sash as described. The window unit may then be mechanically clamped in a fixture that holds the sashes straight and the frame square. With the frame straight and square, the coupling member 116 may be installed by sliding one end portion into the slot 38 of either the clip 10 on the right side of the window frame 103 or the clip 10' on the left side of the window frame 103. A right handed installer, for example, may prefer to start by sliding an end of the coupling member into the slot of the clip on the left side of the window frame 103. It is preferred that an edge of the coupling member 116 be slid completely into the slot so that the edge of the coupling member engages the bottom of the slot. This ensures that when a fastener is installed, the fastener will pierce and secure the coupling member 116 in the proper position within the slot.

With the coupling member 116 properly positioned, a fastener, preferably a screw, is extended through the upper fastener passage 50 and through approximately the center of the coupling member 116. The screw is then driven into the window frame 103, thereby securing the packaging clip 10 in a fixed position and locking the end portion of the coupling member 116 into its slot. The fastener 112 should be snug but without crushing or breaking the packaging clip, and should be of a sufficient length so that it does not pierce the outside face of the jamb. Tightening the fastener 112 causes the slot 38 to close and clamp onto the end portion of the coupling member thereby locking the end portion of the coupling member to the clip. If the window 102 is a larger window unit, or the upper and lower sashes 104, 106 are larger or heavier, it may be desirable to drive a fastener through the lower fastener passage 52 and into the frame for added security. The first packaging clip 10 is now securely installed and the end portion of the coupling member 116 is locked therein.

The coupling member 116 is then extended across the window frame 103 from packaging clip 10 to packaging clip 10' (or vice versa), pulled taught, and secured to packaging clip 10' in the same manner to form the packaging system 100. With the packaging system 100 installed, the window unit may be removed from the clamping fixture. The packaging system insures that the window frame 103 will remain square, straight, and secure during shipment and will maintain this configuration during installation. Furthermore, since the coupling member 116 does not wrap around the outsides of the jambs, it does not interfere with shimming or with the mulling process during installation or when individual window units are joined to form compound window units in the field. Thus, window units can be positioned in a roughed-in opening, shimmed plumb and square, and secured with fasteners through its nailing flange or brick mould to the framing members surrounding the opening, all the while being retained square and straight by the packaging and installation system disclosed herein.

After a window unit is installed in a roughed-in opening as described, the clips 10 and coupling member 116 can be removed by removing the screws, cutting the coupling member, or otherwise removing the packaging system. Afterward, it is preferred that the screws removed from the clips be driven back into their original holes to seal any moisture passageways that may have been formed by the holes. Thus, the system holds the window straight and square during installation and maintains the proper clearance gap between the jambs and sashes to insure the proper sliding operation of the sash while simultaneously maintaining proper contact between the sash and weather stripping to prevent drafts and leaks. Once affixed within the opening, these characteristics are preserved in the installed window.

Figure 3:
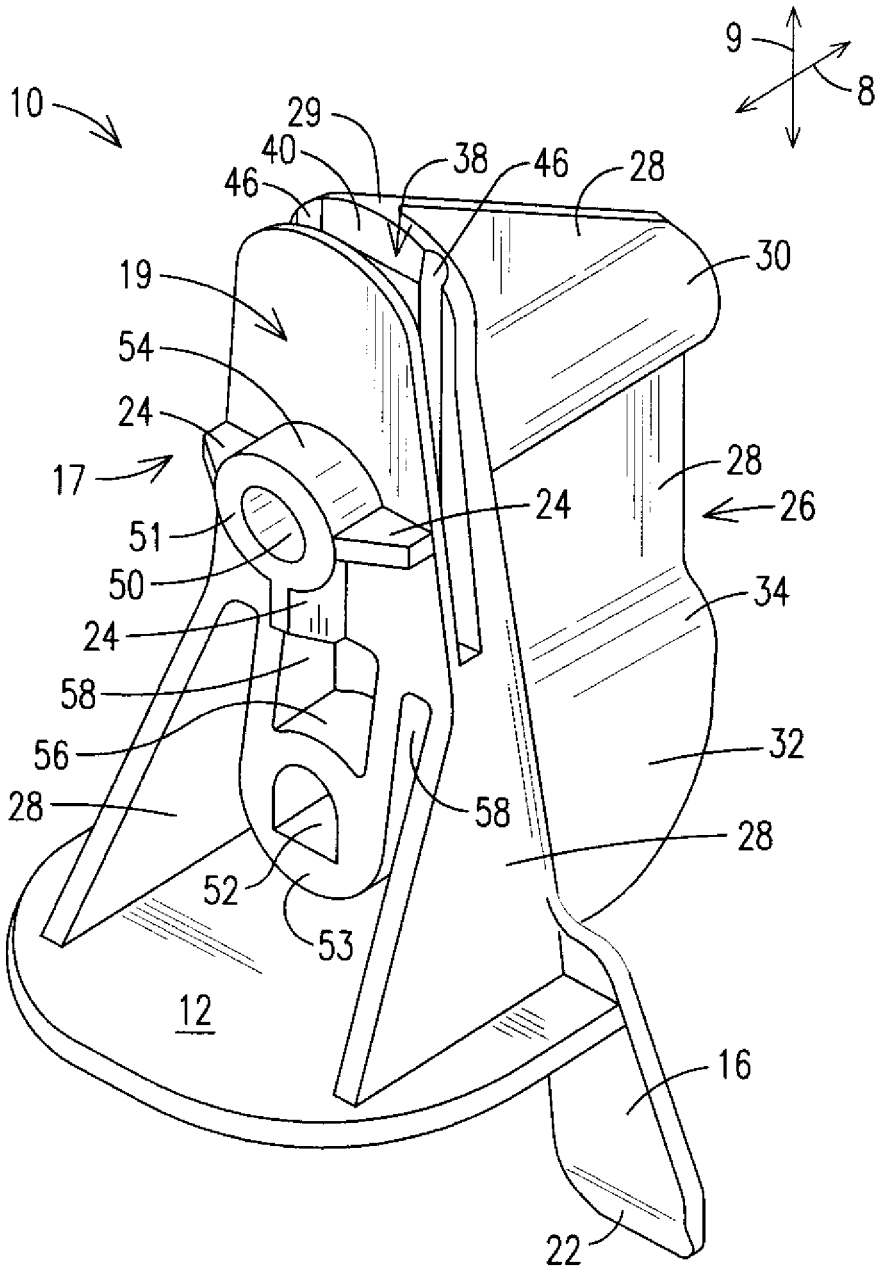
FIG. 3 is a front perspective view of one embodiment of a packaging clip embodying principles of the present invention.
Figure 4:
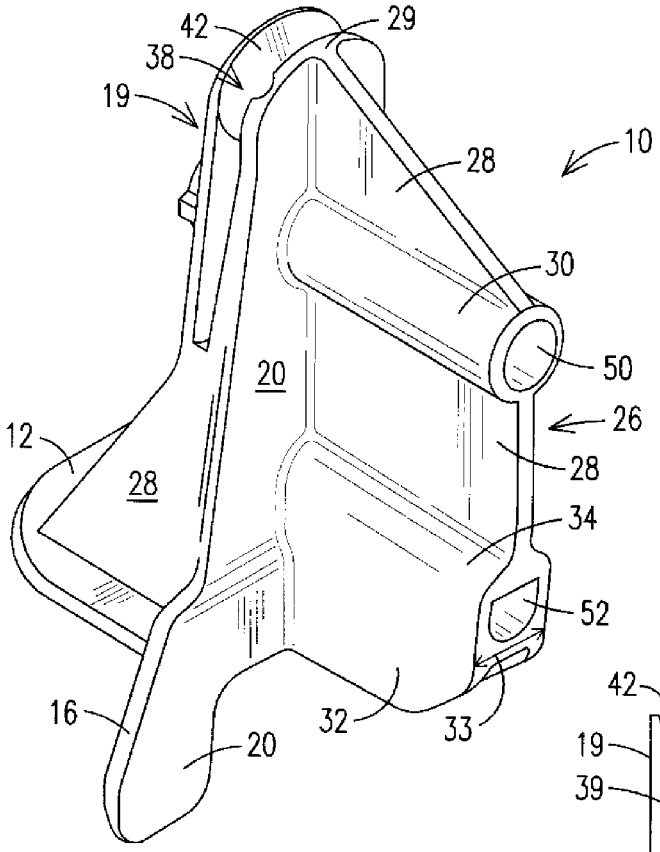
FIG. 4 is a rear perspective view of the packaging clip of FIG. 3.

Reference will now be made to FIGS. 3-6, which show several different views of a packaging clip 10 according to one exemplary embodiment of the invention. For reference, a horizontal direction 8 and a vertical direction 9 are shown indicated in FIG. 3 and are intended to apply throughout. FIG. 3 is a front perspective view of the packaging clip 10. The packaging clip 10, preferably molded of an appropriate plastic material, has a base 12, which has a base lower surface 14 for contacting a portion of a lower window sash, specifically the top of the check rail. The base lower surface 14 preferably is slightly convex is shape so that the edges of the lower surface 14 do not tend to mar or scratch the top surface of the check rail during the jostling and small relative movements that can occur during shipment. A rear surface 20, which may be substantially flat or slightly concave, contacts a portion of a jamb of the window frame. The packaging clip 10 further comprises a rear insert 26 that extends from the rear surface 20 generally in the horizontal direction 8. The base 12 and the rear surface 20 are approximately perpendicular relative to each other and the flat surface 20 and the rear insert 26 are approximately perpendicular relative to each other.

A pair of struts 23 extends upward from the base 12 and form a portion of a frame of the packaging clip 10. The struts 23 function to strengthen the packaging clip 10 by at least increasing a bending stiffness in the horizontal direction 8, and also facilitate fabrication of the component 10. The struts 23 are illustrated as generally triangular in shape but may be any shape and thickness necessary to increase the strength of the frame. Furthermore, the struts 23 may facilitate fabrication of the packaging clip 10 in that they provide features that may improve removal of a molded clip from a mold during an injection molding process. The struts 23 may taper near an upper portion 17 of the packaging clip 10.

A pair of spacer tabs 16 extends or depends vertically downward below the base lower surface 14 and form a portion of the rear surface 20. As perhaps most clearly seen in FIG. 5, the spacer tabs 16 may have a spacer taper 22 to facilitate insertion of the spacer tabs 16 into a space, or clearance, between the lower window sash and the adjacent jamb of a window frame as described above. The spacer tabs 16 may have a pre-determined thickness 18 such that a desired clearance between the window sash and the window jamb is maintained when the spacer tabs are in position and the coupling member installed. The desired clearance maintains the proper spacing between the sash and the jamb to ensure smooth sliding motion of the sash and also proper functioning of weather stripping after the window is installed and the packaging system is removed. The spacer tabs 16 are generally planar in shape and are sized to provide adequate support against bending when the packaging clip 10 and coupling member are installed.

The packaging clip includes at least one fastener passage and in the embodiment illustrated, the packaging clip 10 includes two fastener passages, an upper fastener passage 50 and a lower fastener passage 52. The upper fastener passage 50 and lower fastener passage 52 extend from a front 19 of the packaging clip 10 toward the rear surface 20 and through the rear insert 26 generally in the horizontal direction 8. The upper fastener passage 50 and lower fastener passage 52 provide a passageway for a respective fastener to extend from the front 19 of the packaging clip 10 and exit through a rear edge of the rear insert 20 and into the window frame to secure the packaging clip 10 in place. The upper fastener passage 50 may be the primary fastener passage and may receive a single fastener for use with all window sizes. For larger window frames, both the upper fastener passage 50 and lower fastener passage 52 may each receive a fastener for a stronger hold.

A fastener, generally a screw, may extend from the front of the package clip 10, through a fastener passage (either the upper fastener passage 50, the lower fastener passage 52, or both the upper fastener passage 50 and the lower fastener passage 52) and exit the packaging clip 10 to be driven into a window frame. The fastener functions to anchor the packaging clip 10 in the installed position to the window frame when the fastener is inserted through the respective fastener passage and driven into the window frame. Each fastener may have a fastener head and when the fastener is installed, the fastener head may rest against an upper rim 51, for example, if the fastener is installed in the upper fastener passage 50, or a lower rim 53, for example, if the fastener is installed in the lower fastener passage 52. With the fastener head abutting the rim (either the upper rim 51 or the lower rim 53), the packaging clip 10 remains in the proper position relative to the window frame.

An upper fastener passage protrusion 54 and a lower fastener passage protrusion 56 each extend from the front 19 of the packaging clip 10. The upper fastener passage 50 has a plurality of ribs 24 that extend from the upper fastener passage protrusion 54 and interface with the front 19. The ribs 24 at least function to strengthen the packaging clip 10, in particular, near the upper fastener passage 50. A plurality of casting or molding features 58 extend from the lower fastener passage protrusion 56. The casting features 58 primarily aid in the fabrication of the packaging clip 10 but may also strengthen the packaging clip 10 near the lower fastener passage protrusion 56.

Figure 5:
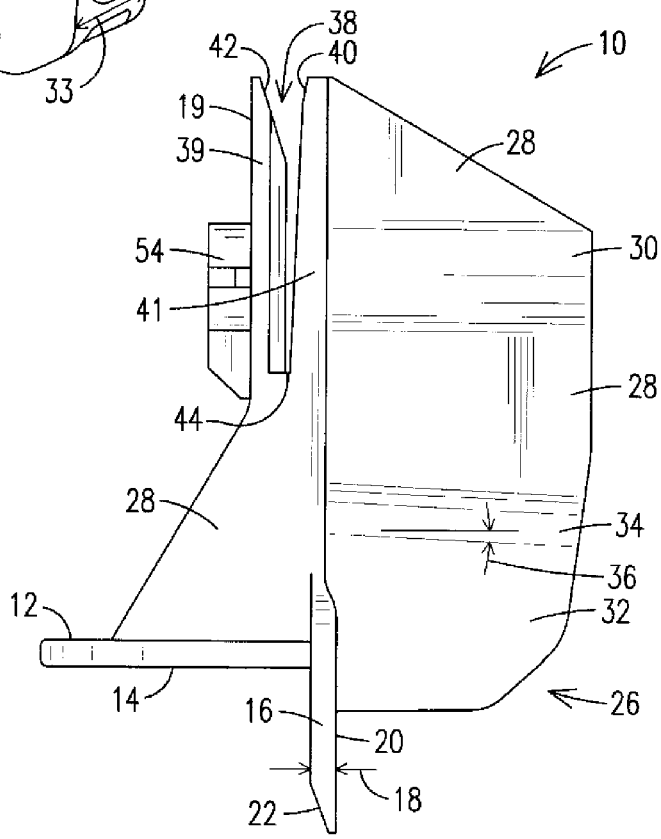
FIG. 5 is a side elevation view of the packaging clip of FIG. 3.

The upper fastener passage 50 is about parallel with the base lower surface 14 of the packaging clip 10 and extends in the horizontal direction 8. Thus, a fastener inserted through the upper fastener passage 50 will be about parallel with the base lower surface 14 of the packaging clip 10. Referring to FIG. 5, it can be seen that the lower fastener passage 52 is tilted downward at an angle 36 relative to the horizontal direction 8, extending from the front 19 to the rear edge of the rear insert 26. Thus, a fastener inserted through the lower fastener passage 52 will be substantially parallel with the angle 36 and will extend at this angle into a window frame. The lower fastener passage 52 is arranged at the angle 36 for installation purposes of a fastener in the lower fastener passage 52, e.g. it may be easier to install the fastener at a slight angle 36 to avoid damaging the packaging clip 10 or window sash with the chuck of a powered screw driver used to drive the fastener. The angled insertion of a fastener also may pull the clip down tightly against the check rail of the lower window sash.

The rear insert 26 of the packaging clip 10 is comprised of a plurality of webs 28, a rear upper fastener protrusion 30, a rear lower fastener protrusion 34 and a lower insert portion 32. The webs 28 extend between the rear upper fastener protrusion 30 and the rear lower fastener protrusion 34, as well as from the rear upper fastener protrusion 30 to a top end 29 of the packaging clip 10. The webs 28 form a portion of the frame of the packaging clip 10 and at least function to strengthen the packaging clip 10. As illustrated, the rear lower fastener protrusion 34 is integral with the lower insert portion 32 and has a lower insert portion width 33. The rear upper fastener protrusion 30 may have a width substantially the same as the lower insert portion width 33. The lower insert portion 33 is about the same (or slightly less) width as the width of a jamb track channel on the window frame that the rear insert 26 is disposed within when installed. It is useful to provide a clearance between the rear insert 26 and channel 114 to accommodate any expansion of either the rear upper fastener protrusion 30 or the rear lower fastener protrusion 34 that may occur when a fastener is installed and tightened in either passage 50, 52. Since the width 33 of the lower insert portion 32 and the width of the rear upper fastener protrusion 30 are about the width of the channel, the packaging clip 10 may be more firmly held when the rear insert 26 is disposed within the channel. When installed, the rear insert 26 may be within the jamb track channel 114 and the rear surface 20 of the packaging clip 10 may rest against the window jamb on either side of the jamb track channel.

A slot 38 is formed toward the top end 29 of retainer 7 and extends in the vertical direction 9. With reference to FIG. 5, the slot 38 forms an opening in the top end 29 of the retainer to receive the end portion of a coupling member as described in more detail below. The slot 38 extends a vertical distance into the packaging clip 10 such that a slot base 44 is vertically below the upper fastener passage 50. It is preferred that the slot base 44 be below the upper fastener passage 50 so a fastener inserted through the upper fastener passage 50 will pass through and secure the end portion of the coupling member in a fixed position. As viewed from the side (See FIG. 5), the slot 38 may be wedge shaped, coming to a substantial edge at the slot base 44. When a fastener is installed within the upper fastener passage 50 and driven into a window frame, an outer slot portion 39 is drawn toward an inner slot portion 41. When the outer slot portion 39 moves toward the inner slot portion 41, locking features 46, 48 engage to capture and lock the end portion of a coupling member tightly within the slot. Toward the top end 29 of the packaging clip 10, the slot 38 may be flared. The flared portion is comprised of an outer guiding feature 42, arranged toward the front 19 of the packaging clip 10 and an inner guiding feature 40, arranged toward the rear surface 20 of the clip 10. The outer guiding feature 42 and the inner guiding feature 40 provide guidance to facilitate installation of the coupling member within the slot 38.

Figure 6:
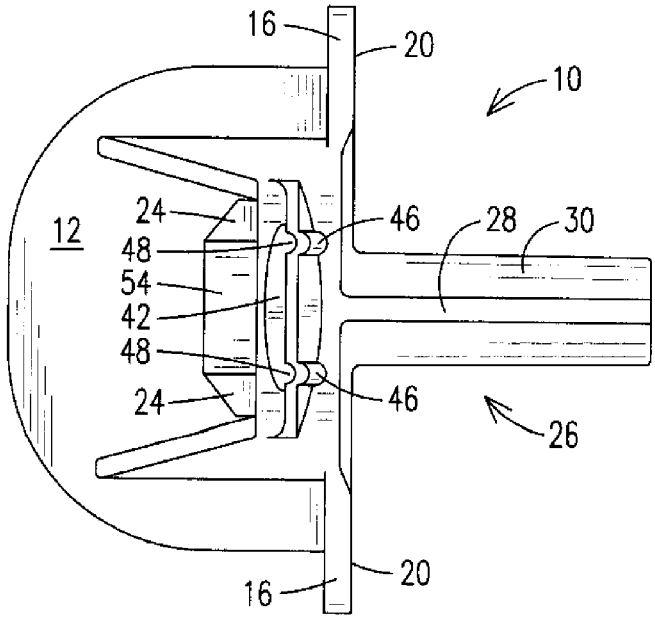
FIG. 6 is a top plan view of the packaging clip of FIG. 3.

FIG. 6 is a top view of the packaging clip 10. Band locking features 46, 48 are shown as a feature of the slot 38. Male locking features 48 are arranged on one side of the slot 38 and each male locking feature 48 is sized to fit within a female locking feature 46 when the slot 38 is drawn shut. The male locking feature 48 has a contour that conforms to a contour of the female locking feature 46. Thus the male locking feature 48 fits snugly within the female locking feature 46. The locking features 46, 48 help to secure the coupling member in position when a screw is driven through the opening feature and into the frame.

The packaging clip 10 may be made from any suitable material. Preferably, the packaging clip is made from a plastic or polymer material that may be injection molded. The packaging clip may be fabricated from a metal or alloy as well. However, it is preferred that the packaging clip be produced from a polymer.

Alternative embodiments are also possible. For example, coupling member 116 may be a strap as illustrated or a string, cable, wire, or other long thin member, with appropriate fastening and tensioning devices in the packaging clips, coupling member 116 may also be a variable length coupling member, such a strap, string, or other like member looped around a coupling portion of each packaging clip and attached to itself in an adjustable overlapping manner. Elastically extensible flexible members of the general type known as bungee cords may also be used. In yet other embodiments, the coupling member may be in two parts, with each part attached to a packaging clip, with the two parts being connected by a tensioning device, such as a spring or toggling lever device, as would be apparent to one skilled in the art. While it is convenient for coupling member 116 to be a flexible material, non-flexible coupling members are also contemplated. For example, the coupling member could be made up of a first connecting part hingedly coupled to the first clip and a second connecting part hingedly coupled to the second clip, wherein the first and second connecting parts overlap and are clamped or otherwise attached to one another. Alternative configurations for the coupling members will be apparent to one skilled in the art.

Attachment of the coupling member to the packaging clips need not involve the screw holding the clips to the jamb, but could involve other fastening means, such as wedging or jamming devices on the clips, or looping around a post on the clip and attaching a portion of the coupling member to itself. Other coupling member configurations and attachment methods will be apparent to one skilled in the art, and are considered to be within the scope of the invention. Likewise, some jambs may include features that allow the packaging clips to be attached to them without the need for screws threading into the jamb.

Figure 8:
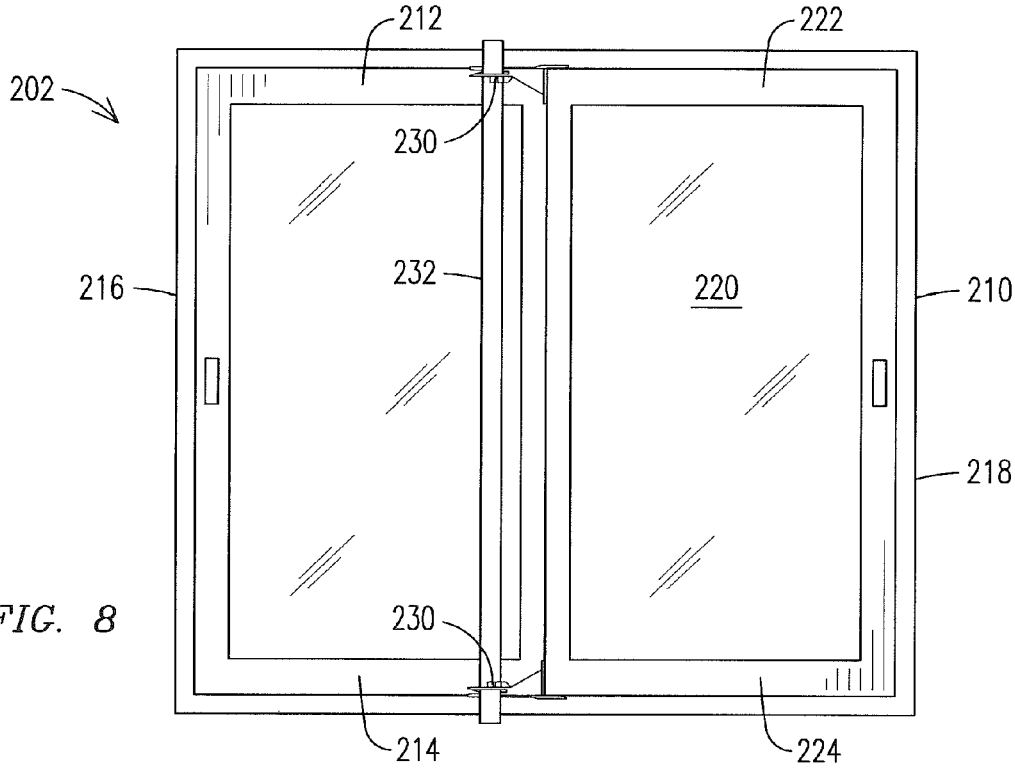
FIG. 8 is a front elevation view of the packaging system shown installed to a sliding door.

Of course, if the sliding closure is a window as in the preferred embodiment described above, the clips are attached to the side frame members or jambs of the window frame. However, if the sliding closure is a gliding window or a sliding door 202, as shown in FIG. 8, the sliding panel 220 has top and bottom edge portions 222, 224 that move along opposed top and bottom frame members 212, 214 of the frame 210. As such, the clips 230 of this invention when used to secure and square a sliding closure 219 with horizontally sliding panels 220 are attached to the opposed top and bottom frame members 212, 214 rather than the opposing side frame members 216, 218, and the coupling member 232 is stretched between the clips 230 between the top and bottom frame members.

The invention has been described above within the context of a preferred exemplary embodiment considered by the inventors to be the best mode of carrying out the invention. It will be apparent to those skilled in the art; however, that various additions, deletions, and modifications of the above described embodiment, both subtle and gross, can be made without departing from the spirit or scope of the invention. For example, the particulars of the clip of the illustrated embodiment are not limiting and a wide variety of shapes, features, and configurations of a clip may be developed by the skilled artisan so long as the clip performs the functions ascribed to the illustrated embodiment. The ends of the coupling member may be secured to the clip in ways other than being captured within a slot such as, for instance, by being wrapped around a feature of the clip or simply screwed to the surface of the clip. These and many other revisions are possible within the scope of the invention, which is delimited only by the claims.

What is claimed is:

1. A window unit comprising:

a frame having spaced jambs with ends;

at least one sash mounted in the frame and having sides residing adjacent respective jambs of the frame;

a first clip secured to one of the jambs proximate a center of the frame between the ends;

a second clip secured to the other one of the jambs proximate the center of the frame between the ends;

an elongated coupling member having end portions;

one end portion of the coupling member being secured to the first clip;

the other end portion of the coupling member being secured to the second clip;

the coupling member extending between the first and second clips and being drawn sufficiently tightly to pull the first and second clips toward each other to hold the frame of the window unit square and secure during shipment and installation of the window unit; and the first clip, second clip, and coupling member being removable after installation of the window unit.

2. A window unit as claimed in claim 1 wherein the at least one sash comprises a first sash slidable within the frame in the directions of the jambs and a second sash, the first sash having stiles adjacent the jambs and a check rail.

3. A window unit as claimed in claim 2 further comprising jamb track channels formed along the jambs for guiding the first sash.

4. A window unit as claimed in claim 3 wherein the first clip comprises a rear insert extending at least partially into the jamb track channel of one jamb and the second clip comprises a rear insert extending at least partially into the jamb track channel of the other jamb.

5. A window unit as claimed in claim 4 wherein the first and second clips are secured to respective jambs with fasteners driven through the clips and into the adjacent jamb.

6. A window unit as claimed in claim 5 wherein the first and second clips further comprise a base configured to rest against the check rail of the sash to hold the sash in a closed position during shipment and installation.

7. A window unit as claimed in claim 6 wherein the first and second clips further comprise a retainer projecting upwardly from the base, the fasteners extending through the retainer into respective jambs of the frame.

8. A window unit as claimed in claim 7 wherein the retainers of the clips define slots and wherein the end portions of the coupling member are captured within the slots of the retainers.

9. A window unit as claimed in claim 8 wherein the slots are closed and clamped onto the end portions of the coupling member by the fasteners.

10. A window unit as claimed in claim 2 wherein the clips further comprise tabs extending between the stiles of the sash and the adjacent jambs to maintain a desired clearance therebetween during shipment and installation.

11. A window unit as claimed in claim 10 wherein each of the clips comprises a base resting against the check rail of the sash and a retainer projecting upwardly from the base, the end portions of the coupling member being fixed to the retainers of the clips.

12. A window unit as claimed in claim 11 and further comprising slots defined in the retainers, the end portions of the coupling member extending through the slots and the slots being closed shut on the end portions of the coupling member to secure the coupling member in place.

13. An apparatus for maintaining a window unit square and secure during shipment and installation, the window unit having a frame with opposed jambs, opposed ends, and at least one sash having stiles adjacent the jambs and a check rail, the apparatus comprising;

a first clip configured to be removably secured to one jamb at an end of the check rail of the sash when the check rail is positioned proximate a center of the frame between the opposed ends;

a second clip configured to be removably secured to the other jamb at an opposite end of the check rail of the sash;

a coupling member having end portions; and the clips comprising features configured to capture and hold the end portions of the coupling member when the clips are secured to the jambs such that the coupling member can be drawn sufficiently tight to pull the first and second clips toward each other to secure the window unit and hold the window unit in a square configuration during shipment and installation.

14. The apparatus of claim 13 wherein the clips further comprise tabs configured to extend between the stiles of the window sash and the adjacent jambs to maintain a predetermined clearance gap between the stiles and the jambs during shipment and installation.

15. The apparatus of claim 13 wherein the clips further comprise bases configured to rest against the check rail of the sash when the clips are installed to secure the sash in a closed position during shipment and installation.

16. The apparatus of claim 13 wherein each of the clips comprises a retainer configured to capture and hold an end of the coupling member when the apparatus is installed on a window unit.

17. The apparatus of claim 16 wherein the retainers of the clips define a slot sized to receive and end portion of the coupling member and to be closed onto the end portions of the coupling member to secure them to the clips.

18. The apparatus of claim 17 further comprising fasteners configured to extend through the clips and be driven into the jambs to secure the clips to the jambs, the slots being closed onto the end portions of the coupling member when the fasteners are driven into the jambs.

19. A method of securing the window unit of claim 1 and maintaining the window unit in a substantially square configuration during shipment and installation, the method comprising the steps of:

(a) locating a first clip on an inside face of a jamb of the window unit intermediate the ends of the jamb;

(b) locating a second clip on an inside face of an opposite jamb of the window unit intermediate the ends of the opposite jamb;

(c) securing one end portion of a coupling member to the first clip;

(d) securing the first clip to the jamb;

(e) extending the coupling member across the window unit to the second clip;

(f) pulling the coupling member sufficiently tightly to hold the window unit in a square configuration;

(g) securing the other end portion of the coupling member to the second clip; and (h) securing the second clip to the opposite jamb.

20. The method of claim 19 where in step (b) the second clip is positioned opposite the first clip.

21. The method of claim 19 wherein steps (c) and (d) are accomplished together.

22. The method of claim 21 wherein steps (c) and (d) are accomplished by driving a fastener through the first clip and into the jamb.

23. The method of claim 21 wherein steps (g) and (h) are accomplished together.

24. The method of claim 23 wherein steps (g) and (h) are accomplished by driving a fastener through the second clip and into the opposite jamb.

25. A sliding closure comprising:

a frame formed of spaced parallel frame members including opposing side frame members and opposing top and bottom frame members;

at least one sliding panel mounted in the frame and having opposite edge portions residing adjacent a selected pair of opposing frame members of the frame, the sliding panel being movable within the frame along the selected pair of opposing frame members;

a first clip secured to one of the selected pair of opposing frame members proximate a center of the frame between the ends;

a second clip secured to the other one of the selected pair of opposing frame members proximate the center of the frame between the ends;

an elongated coupling member having end portions;

one end portion of the coupling member being secured to the first clip;

the other end portion of the coupling member being secured to the second clip;

the coupling member extending between the first and second clips and being drawn sufficiently tightly to pull the first and second clips toward each other to hold the frame of the sliding closure square and secure during shipment and installation of the sliding closure; and the first clip, second clip, and coupling member being removable after installation of the window unit.

26. The sliding closure of claim 25 and wherein the closure is a window, the sliding panel is a sash, and the selected pair of opposing frame members comprises the opposing side frame members.

27. The sliding closure of claim 25 and wherein the closure is a sliding door, the sliding panel is a door panel, and the selected pair of opposing frame members comprises the opposing top and bottom frame members.

* * * * *

UNITED STATES PATENT AND TRADEMARK OFFICE

CERTIFICATE OF CORRECTION

PATENT NO. : 8,733,545 B2
APPLICATION NO. : 13/368949
DATED : May 27, 2014
INVENTOR(S) : Weiss et al.

It is certified that error appears in the above-identified patent and that said Letters Patent is hereby corrected as shown below:

On the title page item [73]

Delete "Anderson Corporation, Bayport, MN (US)

Insert -- Andersen Corporation, Bayport, MN (US) --

Signed and Sealed this
Fifteenth Day of December, 2015

Michelle K. Lee

Michelle K. Lee
*Director of the United States Patent and Trademark Office*